United States Patent [19]

Okada

[11] Patent Number: 5,004,238

[45] Date of Patent: Apr. 2, 1991

[54] BALL-SHOOTING GAME MACHINE

[75] Inventor: Kazuo Okada, Tokyo, Japan

[73] Assignee: Universal Company, Ltd., Japan

[21] Appl. No.: 418,346

[22] Filed: Oct. 6, 1989

[30] Foreign Application Priority Data

Oct. 13, 1988 [JP] Japan ..... 63-258159

[51] Int. Cl.[5] ..... A63F 7/00

[52] U.S. Cl. ..... 273/121 B; 273/121 A; 273/122 A; 273/123 A; 273/124 A; 273/125 A

[58] Field of Search ..... 273/121 A, 121 B, 122 A, 273/123 A, 124 A, 125 A, 126 A

[56] References Cited

U.S. PATENT DOCUMENTS

| | | | |
|---|---|---|---|
| 3,383,111 | 5/1968 | Lucas | 273/121 B |
| 3,656,754 | 4/1972 | Clark | 273/124 A |
| 4,508,336 | 4/1985 | Yokoi | 273/121 B |

FOREIGN PATENT DOCUMENTS

| | | | |
|---|---|---|---|
| 0024740 | 2/1977 | Japan | 273/121 B |
| 0052729 | 4/1977 | Japan | 273/121 B |
| 0072646 | 6/1977 | Japan | 273/121 B |
| 0008230 | 1/1978 | Japan | 273/121 B |
| 0008231 | 1/1978 | Japan | 273/121 B |
| 0017439 | 2/1978 | Japan | 273/121 A |
| 0014834 | 2/1979 | Japan | 273/121 B |
| 0070639 | 6/1979 | Japan | 273/121 B |

*Primary Examiner*—Benjamin Layno
*Assistant Examiner*—Raleigh W. Chiu
*Attorney, Agent, or Firm*—Waldron & Associates

[57] ABSTRACT

In a ball shooting game machine, such as a pachinko game machine having winning holes, controls for permitting the player to obtain winning balls regardless of his skill, wherein the controls effect a first state disadvantageous to the player and then a second state advantageous to the player, the controls including means for detecting shot balls reaching the game board, a random number generator for generating a random number when a preselected number of balls are shot, and means for driving or controlling the winning holes to effect the advantageous state in response to the generation of a preset specific number by the random number generator, and means for maintaining or reversing the advantageous state in response to whether or how many winning balls are achieved.

9 Claims, 7 Drawing Sheets

BALL-SHOOTING GAME MACHINE

BACKGROUND OF THE INVENTION

1. Field of the Invention

This invention relates to a ball-shooting game machine such as a pachinko game machine and, more specifically, to a ball-shooting game machine, in which game balls shot from a ball shooter to a game zone over a game board are detected and the game controlled according to the number of detected shot balls.

2. Description of the Prior Art

In a pachinko game machine, a ball shooter is provided for shooting game balls onto a game board surface, having one or more winning holes or other winning devices, and a plurality of nails or pins which interfere with and guide the balls' travel. The object of the game is to get the balls to enter a winning hole or other winning device. It is well known that the probability of producing winning balls; i.e., getting balls to enter winning holes is varied depending on the position, orientation, and angle of nails or pins arranged on the game board surface, as well as the interval between adjacent nails. For the pachinko shot, therefore, the adjustment of nails is an important operation. For the player, on the other hand, it is most important to find a pachinko game machine which has been adjusted to provide a higher probability of producing winning balls.

The adjustment of the orientation, interval, and the like of nails to adjust the probability of producing winning balls, however, requires a very subtle operation involving units of measure as small as 0.01 millimeter, and further requiring experts having sophisticated skill for making adjustments.

Devices have been proposed for adjusting the probability of producing winning balls in a pachinko game machine through automatic nail adjustment. For example:

(1) Japanese Patent Publication No. 59-35633 discloses a device in which the interval between a pair of nails above a winning hole can be varied in a predetermined range; and (2) Japanese Patent Publication No. 61-36949 discloses a device in which the position or inclination of nails associated with each winning hole is varied according to the winning probability of each winning hole.

Techniques are also known for controlling the winning probability without nail adjustment but rather by setting the open-time of a so-called tulip or variable winning device. Examples of these techniques are:

(3) Japanese Patent Publication No. 54-78233 which discloses a device to control the open time of winning device such that the gain index can be set to be in a predetermined range by the pachinko shop; and (4) Japanese Patent Publication No. 61-47548 which discloses a device to designate the open time of winning device according to a random number electronically generated in response to detection of a winning ball.

In the devices (1) and (2) noted above for performing nail adjustment, however, it is necessary to effect subtle adjustment with a high degree of accuracy. Therefore, the adjustment mechanism must be precise and is inevitably expensive, so that it is difficult to adopt such a mechanism to replace the conventional manual adjustment in current machines.

In addition, with the devices (3) and (4) noted above for setting the open time of variable winning devices, it is difficult to permit variable setting of winning probability through fine adjustment like the nail adjustment.

Further, with a pachinko game machine which is subtly adjusted in the manner as described above, the production of winning balls depends to a great extent on the skill of the player. Therefore, it is difficult to obtain winning balls unless the player is highly skilled or a professional. The prior art games, therefore, lack impartiality as a game designed for the unskilled general public.

SUMMARY OF THE INVENTION

An object of this invention is to provide a ball-shooting game machine, which permits winning balls to be obtained, irrespective of the player's skill, with an impartial winning probability without nail adjustments.

According to this invention, there is provided a ball-shooting game machine for playing a game by shooting balls from a ball shooter to a game zone over a game board, which comprises means for detecting and counting the shot balls which provide an output signal whenever a predetermined number of balls is shot from the ball shooter, and a control means for generating a random number according to the output signal from the shot ball detection means and effecting a winning ball probability control according to the generated random number.

As an example of the winning control of this invention, adjustments can be to assume a first state disadvantageous to the player and a second state advantageous to the player. The variable winning devices are driven or controlled to assume a second state advantageous to the player when a predetermined effective number is generated as random number. Therefore, the first and second states can be controlled to occur alternately and repeatedly, as well as to assume the second state continuously. When a predetermined number of winning balls are produced in the variable winning devices being driven; i.e., controlled to effect the second state, the driving is stopped to restore the variable winning devices to the first state. If the predetermined number of winning balls fail to be produced, the number of deficient winning balls is added to the next driving; i.e., control activity. In other words, the next driving or control activity is continued to an extent taking into consideration to the predetermined number plus the number of the previous deficient winning balls.

As a different example of the winning control of this invention, in which the production of a winning ball in a special winning hole called a "starter" causes a separate game to be started, and then the separate game is controlled such that it will end with a particular result when a predetermined number is generated.

In the present invention, as mentioned above, the winning control is such as the driving of the variable winning devices and a specified result of the separate game is effected in response to the detection of the number of shot balls, and the winning probability is determined by generation of a random number and the number of shot balls. Accordingly, a player is given an impartial opportunity of getting or producing winning balls in the winning devices, and may include obtaining prize balls in a separate game. In addition, winning probability can be controlled without the need of the conventional nail adjustment.

In a preferred embodiment of the invention, a means is provided for determining the number of shot balls which are returned without reaching the game zone over the game board, wherein the control means refrains from the random number generation for a number of times corresponding to the number of detected returned balls. Random numbers are thus generated by excluding the returned balls and therefore, only for the shot balls actually reaching the game zone. With this embodiment, more accurate winning control can be obtained.

According to a specific embodiment of the invention, there is provided a ball-shooting game machine having a ball shooter for shooting game balls to a game zone over a game board, which includes variable winning devices capable of being controlled or driven to assume a first state disadvantageous to the player and a second state advantageous to the player. The control is effected by (1) a drive means for driving or controlling the variable winning devices to assume the first and second states, (2) a shot ball detection means for detecting shot balls from the ball shooter, (3) a random number generator for generating a random number in response to an output signal from the shot ball detection means, (4) a judging means for checking random numbers generated from the random number generation means, and (5) a control means for causing the drive means to drive the variable winning devices according to the result of a check by the judging means and until a predetermined number of winning balls are produced in the variable winning devices.

The variable winning devices are classified into two different kinds of winning holes, namely general winning holes and special winning holes, which are provided on the game board together with a separate game device for playing a separate game when a winning ball is produced in a special winning hole, and a changeable winning device capable of assuming a state advantageous to the player according to the result of the separate game by the separate game device.

According to another specific embodiment of the invention, there is provided a ball-shooting game machine having variable winning devices capable of being controlled or driven to assume a first state disadvantageous to the player and a second state advantageous to the player which comprises control means for determining the state of variable winning devices according to a properly generated random number, generating a state indication signal representing the determined state and controlling the variable winning devices according to the content of the state indication signal.

In the actual ball-shooting game, the determination of the state (state indication signal) according to a random number and corresponding result (number of winning balls actually produced) do not necessarily coincide at all times. Specifically, a predetermined number of winning balls are not necessarily produced without failure when the variable winning devices are controlled to assume the second state. Accordingly there may be situations in which less or more winning balls are produced. Furthermore, among the variable winning devices there may be one in which no winning ball can be produced at all in the first state, or in which winning balls can be produced, although difficult, even in the first state. Therefore, according to the invention, the control means compensates the content of the state indication signal in accordance with the previous winning ball production status.

In the above embodiment, the random number generator generates a random number at a suitable time, for example, whenever a predetermined number of shot balls are detected, and then the judging means checks the generated random number. The control means generates a state indication signal according to the result of the check. Where a CPU, such as microcomputer, is used as the control means, the state indication signal is called a "flag" and represents the number of acceptable winning balls (possible number of times for winning) when the variable winning devices are brought to the second state advantageous to the player.

More specifically, if the generated random number is a predetermined effective number or in a predetermined range to set the variable winning devices to the second state, the CPU generates a flag of "1" (when the possible number of times of winning is 1), while switching the variable winning devices from the first state to the second state. At this time, the variable winning devices may be driven to assume the second state continuously or assume the first and second states alternately. When a predetermined number of winning balls are produced with the variable winning devices in the second state, the variable winning devices are restored to the first state.

If a predetermined possible number of winning balls fail to be produced in the variable winning devices in the presence of a flag representing the predetermined possible number, the number of deficient winning balls remaining without being produced is added to the content of the next flag. For example, the flag content may be changed from "1" to "2" as the content of the next flag. Hence, the next driving of the variable winning devices is continued until the winning balls are produced, which correspond in number to the content of the next flag plus the number of the previous deficient winning balls.

On the other hand, if winning balls are produced in excess of the predetermined possible number as indicated by a flag, the number of excess winning balls produced is subtracted from the content of the next flag. For example, the flag content can be changed from "1" to "0" as the content of the next flag. Hence, the next driving of the variable winning devices is continued until the winning balls are produced, which correspond in number to the content of the next flag minus the number of the previous excess winning balls (which may be "0").

In addition to the above, every time a winning ball is produced in a variable winning device in the first state as represented by the state indication signal (i.e., in the absence of any flag representing any predetermined possible number), the next control or driving to the second state is cancelled, that is the flag content is decreased by one.

Pursuant to the above, the probability of switching of the variable winning devices to the second state is determined according to the probability of generation of a predetermined random number, while the state indication signal is compensated according to the actual winning status. The driving control of the variable winning devices thus can be effected accurately.

DETAILED DESCRIPTION OF THE PREFERRED EMBODIMENT

Figure 1:
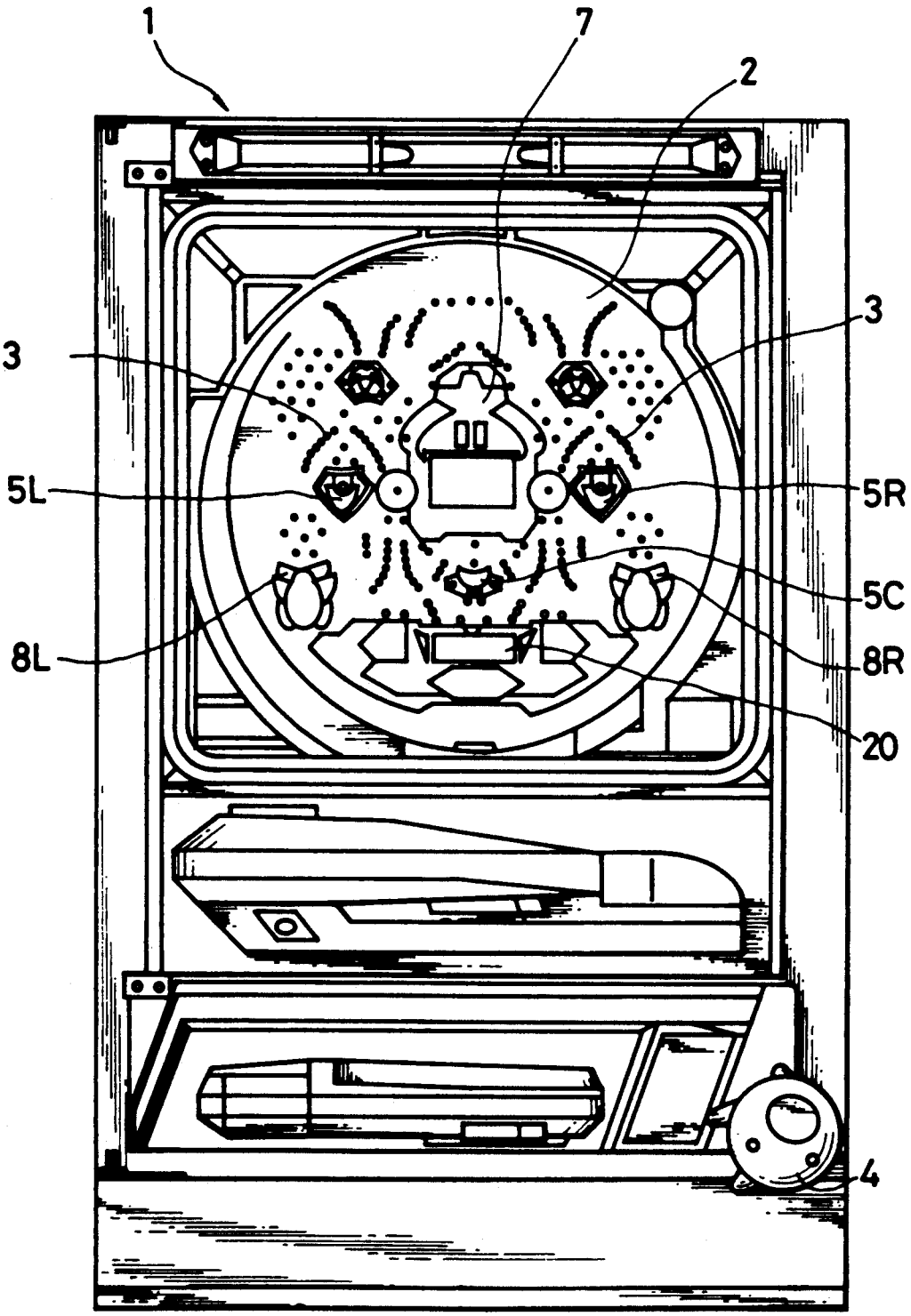
FIG. 1 is a front view showing a pachinko game machine according to one embodiment of the invention.

FIG. 1 is a front view of a pachinko game machine according to one embodiment of the invention. The pachinko game machine, generally designated by reference numeral 1, comprises a game board 2 having a plurality of variable winning devices, which can assume a first state disadvantageous to the player and a second state advantageous to the player with regard to winning of game balls shot from a ball shooter to the game board 2. The variable winning devices are classified into general winning holes and special winning holes as will be described later in detail.

The game board 2 has a plurality of nails 3 arranged as guide means such that a ball shot from the ball shooter may be guided to positions over the variable winning devices. A ball shooting handle 4 is provided on a right lower portion of the front of the machine. When the handle 4 is operated by a player, balls are shot from the ball shooter mounted on the back side of the game board so that they may be guided along a guide rail on the game board 2.

Figure 2:
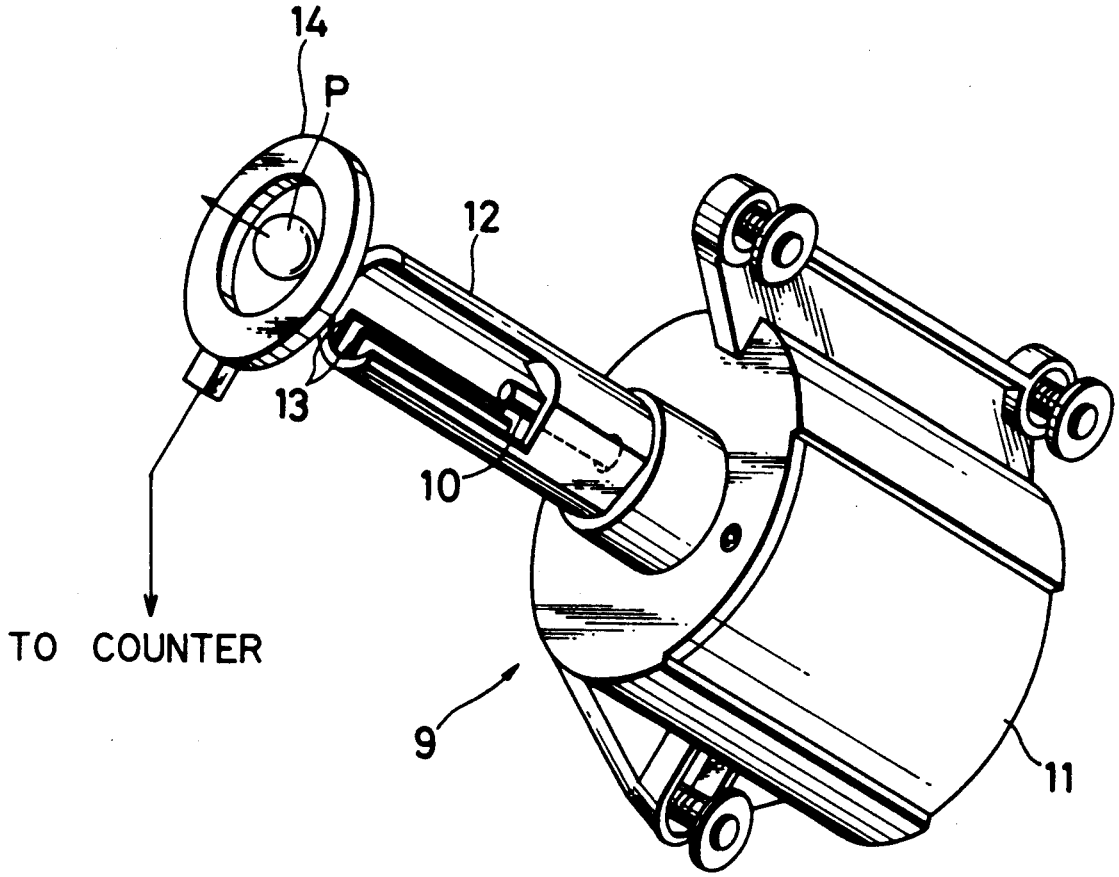
FIG. 2 is a perspective view showing examples of a ball shooter and shot ball sensor.

FIG. 2 shows an example of the ball shooter. This ball shooter 9 includes a ball shooting section 11 having a solenoid for causing advancement of a plunger 10 by an electromagnetic force to shoot a ball P and a ball guide section 12 provided on the side, to which the plunger 10 is advanced. The ball guide section 12 consists of a cylindrical member with a notch formed in a free end portion such that a ball is fed thereto through the notch. The inner bottom surface of ball guide section 12 is provided with a pair of parallel guide ridges 13 for forwardly guiding a ball P shot by an end of the plunger 10.

A shot ball sensor 14 is disposed in front of the ball shooter 9 to detect each ball P shot from the ball shooter, which comprises a magnetic sensor having a hole, through which each shot ball P can pass. The output of the shot ball sensor 14 is supplied to a shot ball counter 61 (FIG. 8) to be described later.

Figure 3:
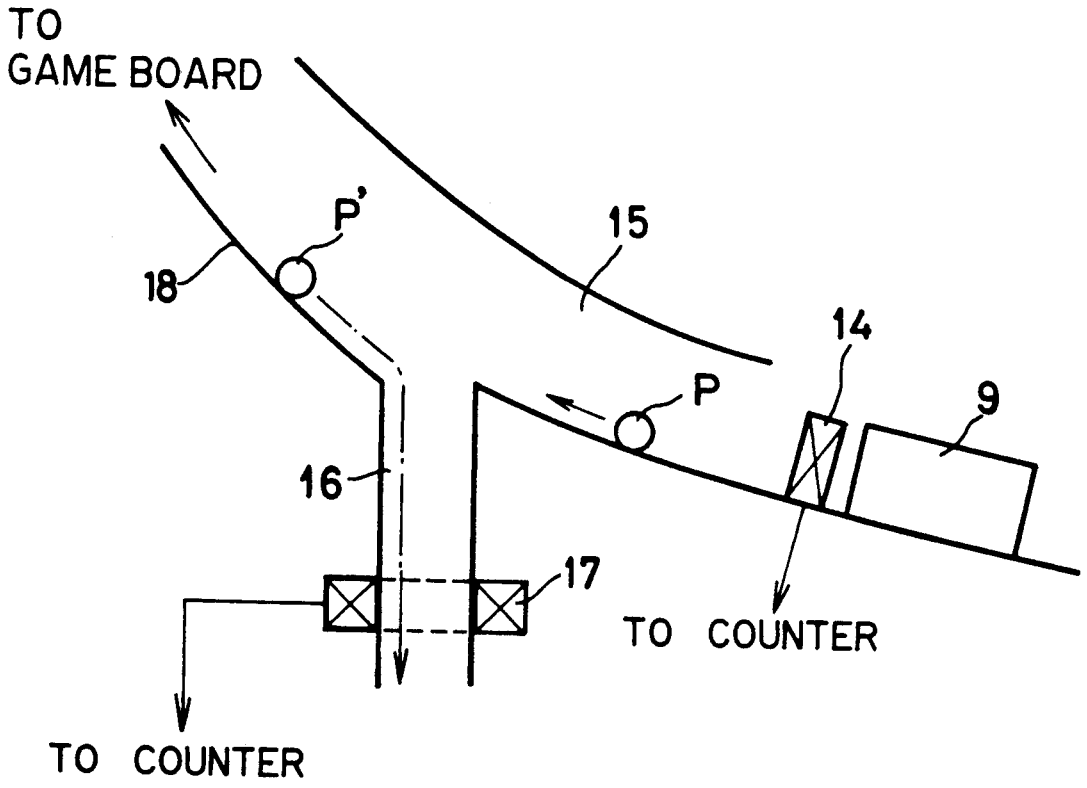
FIG. 3 is a view showing an apparatus of detecting shot balls and returned balls.

Each ball P shot from the ball shooter 9 is guided along a guide rail 18 defining a shot ball path to an upper portion of the game board 2, as shown in FIG. 3. Some shot balls P, however, may be returned toward the ball shooter 9 without reaching a game zone of the game board 2. Such a ball P will fall into a recovery path 16. A returned ball sensor 17 is disposed on an intermediate portion of the recovery path 16 to detect returned balls. The output of the returned ball sensor 17 is supplied to a returned ball counter 62 (FIG. 8) to be described later. Thus, the returned balls which have been returned toward the ball shooter 9 without reaching the game zone over the game board 2, are not counted as shot balls.

In this embodiment, random numbers are generated according to the output signal from the shot ball sensor 14, and when a predetermined number is generated as random number, a plurality of variable winning devices are driven or controlled such that they are continuously or intermittently held in the second state advantageous to the player. When a winning ball is produced, that is, when a ball enters one of the variable winning devices, the driving thereof is reversed to restore the first state. If the winning balls produced before the restoration of the first state is greater or less in number than a predetermined number, a state indication signal (flag) is produced for noting an excess or a deficiency of winning balls.

As a system of driving the plurality of variable winning devices, all the variable winning devices can be driven at a time, or in the alternative, the individual variable winning devices can be driven successively to assume the two states at the same time. In the latter method, there is an excursion of driving of the variable winning devices to make the display more interesting, and when a predetermined number of winning balls are produced, the driving of the variable winning devices being driven is stopped. Thus, compared to the embodiment where all the variable winning devices are stopped, as in the former method, there is less change in the status of the overall variable winning devices, which is desirable from the visual standpoint.

A general winning hole is provided for paying out a predetermined number (for example thirteen) of prize winning balls when a game ball entered the hole. In the embodiment shown in FIG. 1, the general winning holes are formed by variable winning devices 5L, 5R, and 5C, which can be brought to either a first state not permitting, or permitting only with difficulty, production of winning balls or a second state permitting production of winning balls with movement of a winning restriction member located over each hole. The winning devices as shown are disposed on left, right, and central positions of the game board 2, respectively.

Figure 4:
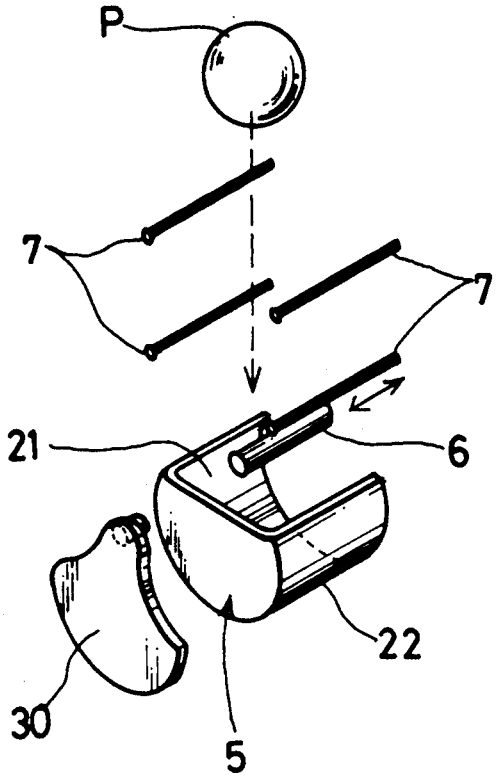
FIGS. 4 and 5 are exploded perspective views showing an example of variable winning hole and drive means therefor.

Each of the variable winning devices 5L, 5R, and 5C, as shown in FIG. 4, includes a cup-shaped ball receiving member 22 provided on the front side of the game board 2, in which game balls P may be received one by one from a top opening 21 and be fed out to the back side of the game board 2, and a winning restriction member 6 which consists of a bar-like movable member which can project to the front side of the game board 2 by penetrating the same. The winning restriction member 6 is driven perpendicularly to the game board 2 by drive means consisting of a ball screw. The front of the variable winning device is preferably covered by a decorative plate to conceal the winning restriction member 6.

Figure 5:
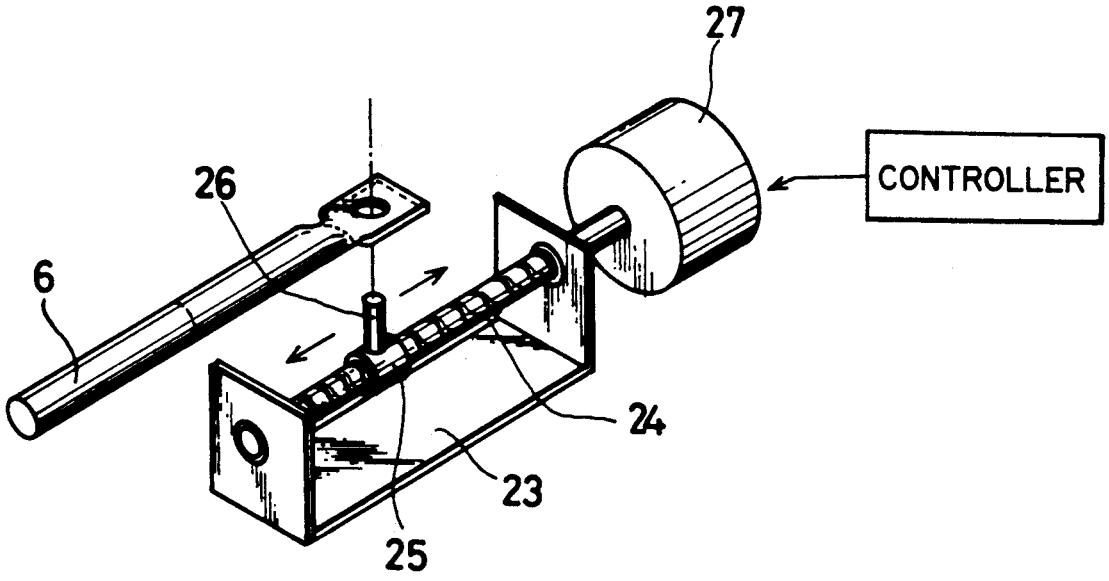

FIG. 5 shows an example of the drive means. As is shown, a channel-shaped bracket 23 is mounted on the back side of the game board 2. A male thread 24 of the ball screw is rotatably supported in the bracket 23. A female thread 25 is screwed on the male thread 24 and has an upward projection 26, to which a rear end of the winning restriction member 6 is coupled. The male thread 24 is coupled to a shaft of a pulse motor 27. When the pulse motor 27 is driven by a suitable controller to cause rotation of the male thread 24, the female thread 25 is moved along the male thread 24 to cause advancement or retraction of the winning restriction member 6 perpendicularly to the game board 2. The displacement of the winning restriction member 6 is determined by a rotational angle of the male thread 24, and the rotational angle is determined by a number of drive pulses for driving the pulse motor 27. Thus, by controlling the number of drive pulses supplied to the pulse motor 27 a position of the winning restriction member 6 forwardly projecting from the game board 2 can be adjusted to switch between the first state in which no game ball P can become a winning ball entering the ball receiving member 22 from the top opening 21, and the second state in which the winning balls can be produced.

The special winning hole is provided for paying out a predetermined number (for example seven) of prize balls when a game ball entered the hole. In addition, at this time it also serves as a starter hole to start a separate game by a variable display device 7 disposed on a central portion of the game board 2. In the embodiment of FIG. 1, the special winning holes are formed by variable winning devices (called tulips) 8L and 8R, each of which can be brought to either a first state not permitting production of winning balls, or a second state permitting production of winning balls with open and close movement of a pair of left and right pivotable members, which are disposed on the game board 2 at left and right positions thereof.

Figure 6B:
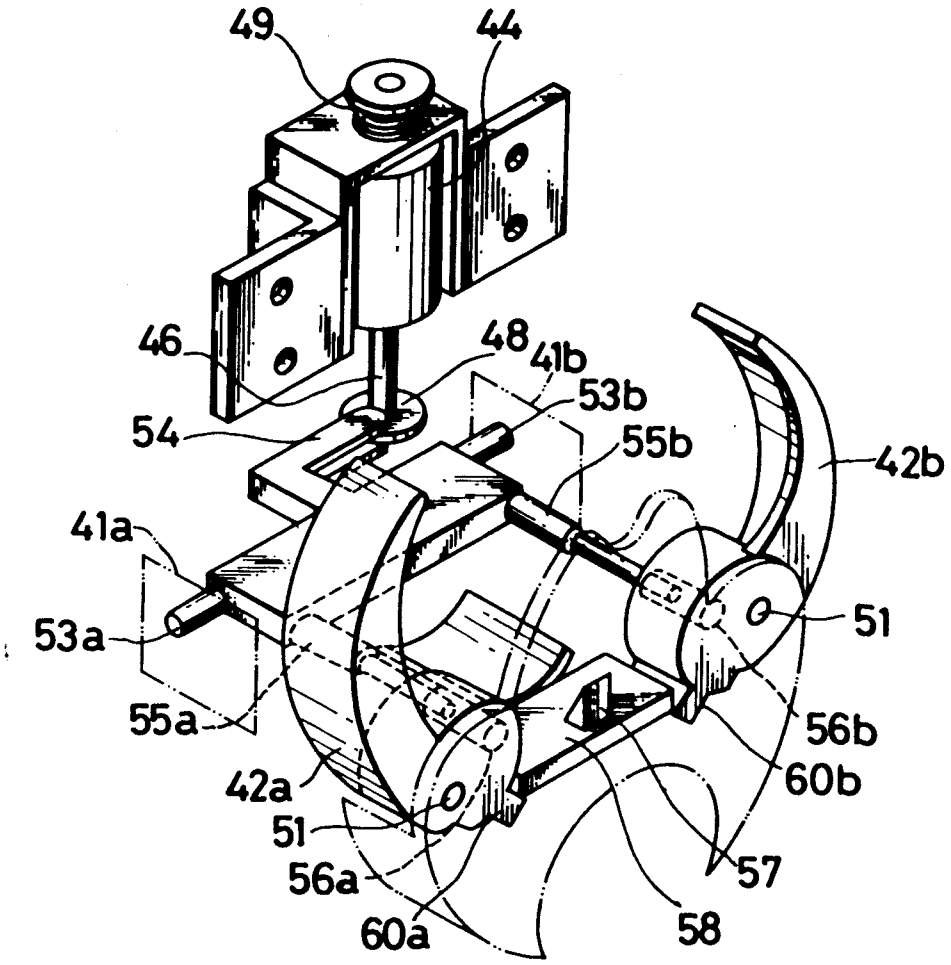
FIGS. 6(A) and 6(B) are perspective views showing an example of a variable winning device.
Figure 6A:
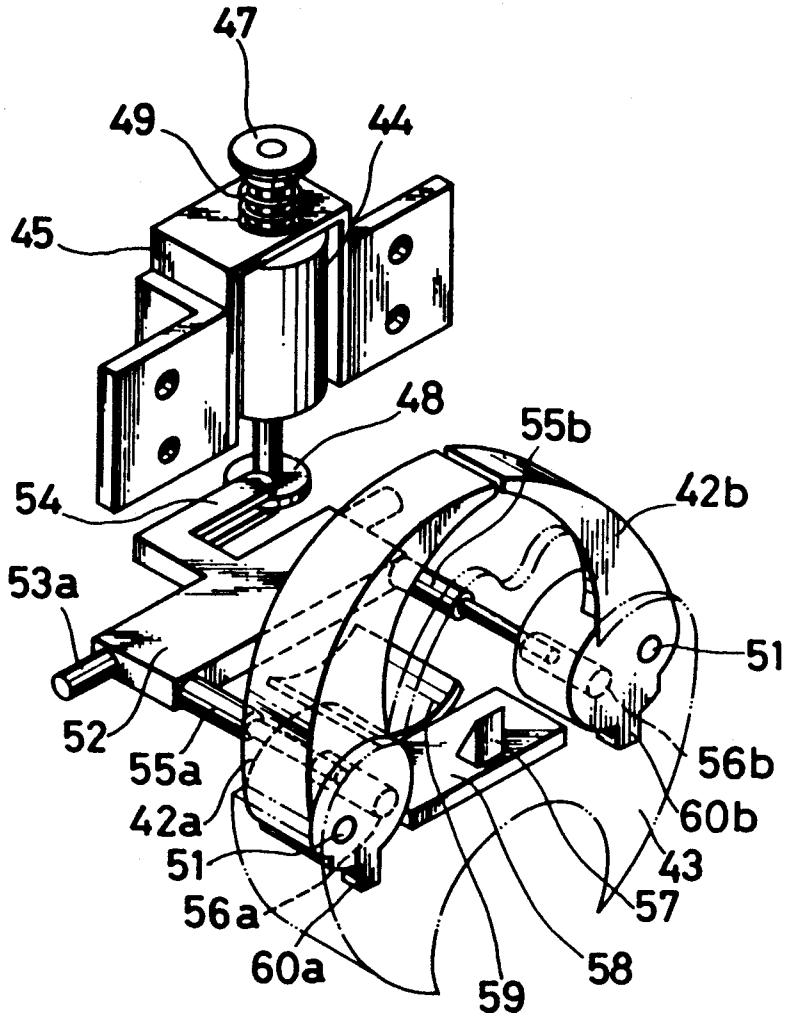

The variable winning devices 8L and 8R each have a construction as shown in FIGS. 6(A) and 6(B). As is shown, a pair of pivotable members 42*a* and 42*b* are pivotably provided on the front side of the game board with their lower portions covered by a cover 43. In this variable winning device, when the pair of pivotable members 42*a* and 42*b* are closed as shown in FIG. 6(A), the first state not permitting production of any winning balls is brought about. When the pair of pivotable members 42*a* and 42*b* are opened as shown in FIG. 6(B), the second state permitting production of winning balls is brought about.

A bracket 45 is disposed on the back side of the game board, to accommodate a solenoid 44. A plunger 46 extending through the solenoid 44, and engagement disks 47 and 48 are secured to the respective upper and lower ends of the plunger 46. A coil spring 49 is provided between the upper engagement disk 47 and an upper surface of the bracket 45. When the solenoid 44 is energized, the lower end of the plunger 46 projects downwardly from the state shown in FIG. 6(A). When the solenoid 44 is subsequently de-energized, the plunger 46 is returned to the initial position by the force of the coil spring 49. In the variable winning devices 8L and 8R, the pair of pivotable members 42*a* and 42*b* are opened and closed by making use of the displacement of the plunger 46.

The pair of pivotable members 42*a* and 42*b*, each having a cylindrical stem, are supported on the inner side of the cover 43 by an eccentric pin 51 extending from the front side of the stem. Between the stem of each of the pivotable members 42*a* and 42*b* and the solenoid 44, there is a motion converting member 52 for converting the vertical reciprocal motion of the plunger 46 to opening and closing motions of the pivotable members 42*a* and 42*b*. The motion converting member 52 mainly consists of a rectangular plate with left and right ears 53*a* and 53*b*, which are rotatably supported in respective left and right supports 41*a* and 41*b* extending rearwardly from a mounting plate (not shown) for the variable winning device. The motion converting member 52 has an L-shaped extension 54 extending from the rear edge and having a bifurcated end portion clamping the lower engagement disk 48 of the plunger, and also has a pair of transmission bars 55*a* and 55*b* extending from the front edge toward the stems of the respective pivotable members 42*a* and 42*b*. The transmission bars 55*a* and 55*b* each have a reduced-diameter free end portion slidably inserted in each of holes 56*a* and 56*b* provided on the back side of the stems of the pivotable members 42*a* and 42*b*.

Between the stems of the pivotable members 42*a* and 42*b* is disposed a winning ball receiving section 58 with a triangular projection 57 for receiving and rearwardly directing winning balls produced when the pivotable members are opened. A winning ball discharge gutter 59 is disposed behind and beneath the section 58. The winning ball receiving section 58, in addition to being able to receive the winning balls, can hold the pair of the pivotable members 42*a* and 42*b* in the open state as shown in FIG. 6(B) in engagement with projections 60*a* and 60*b* downwardly projecting from the stem of the pivotable members 42*a* and 42*b*.

In the variable winning devices 8L and 8R having the above construction, the pair of pivotable members 42*a* and 42*b* are in the closed state as shown in FIG. 6(A) when the solenoid 44 is not energized. When the solenoid 44 is energized, the plunger is lowered against the force of the spring 49 to lower the L-shaped extension 54 of the motion converting member 52 via the lower engagement disk 48. Thus, the motion converting member 52 is rotated to raise the front side transmission bars 55*a* and 55*b*. As a result, the pair of pivotable members 42*a* and 42*b* are opened as shown in FIG. 6(B) to the left and right, respectively, until their lower projections 60*a* and 60*b* strike the winning ball receiving section 58. In this position it is ready to produce winning balls, and the winning balls are discharged from the winning ball receiving section 58 along the discharge gutter 59 to the winning ball path. When the solenoid 44 is de-energized, the plunger 46 is returned to the initial upper position by the force of the coil spring 49. This upward displacement of the plunger 46 causes the motion converting member 52 to be rotated in the opposite direction, thus lowering the transmission bars 55*a* and 55*b*. As a result, the pair pivotable members 42*a* and 42*b* are moved to the closed state.

The variable winning device shown in FIG. 4 (adopting a winning restriction system using a movable bar) is used as a general winning hole while using the variable winning device shown in FIGS. 6A and 6B (opened and closed system) is used as a special winning hole; i.e., a starter hole to start a separate game. However, it is possible to interchange these variable winning devices.

The variable display device 7 for a separate game provided on a central portion of the game board 2 as shown in FIG. 1, and a changeable winning device 20 provided on a lower portion of the game board 2 will now be described.

Figure 7:
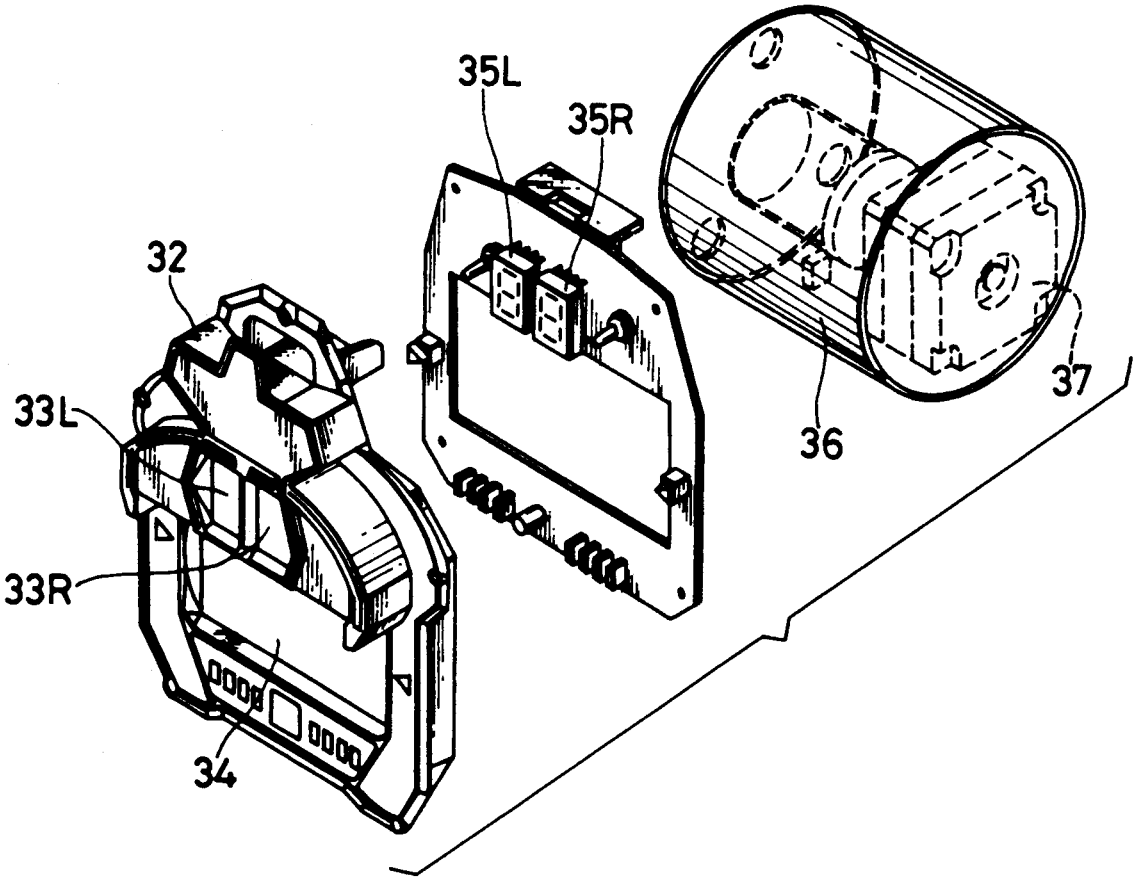
FIG. 7 is an exploded perspective view showing a separate game device.

The variable display device 7, as shown in FIG. 7, has a front section 32 mounted on the front side of the game board 2. The front section 32 has a pair of small openings 33L and 33R formed in upper left and right portions and a large opening 34 formed in a lower portion. Inside the small openings 33L and 33R are disposed respective seven-segment LED (light-emitting diode) display elements 35L and 35R, while inside the large opening 34, a part of outer periphery of a cylindrical reel 36 can be seen. The reel 36 can be rotated about its horizontal axis of rotation in one direction by a reel drive unit 37 including a pulse motor as a drive source. The outer periphery of the reel 36 is covered with a sheet with a plurality (for instance ten) of pattern impressions (not shown). The reel drive unit 37 can position the reel 36 such that one of the pattern impressions of the sheet provided on the reel outer periphery is seen through the large opening 34 of the front section 32 when the rotation of the reel 36 is stopped.

The changeable winning device 20 is commonly termed "attacker" and has a trapezoidal front plate having a top opening. On the front side of this opening a door having substantially the same shape is pivotally mounted while a winning hole is formed inside of the opening. The door of the changeable winning device 20 is driven for opening and closing by a drive mechanism including a solenoid as a drive power source mounted on the back side of the front plate.

An electric circuit section of the embodiment will now be described.

Figure 8:
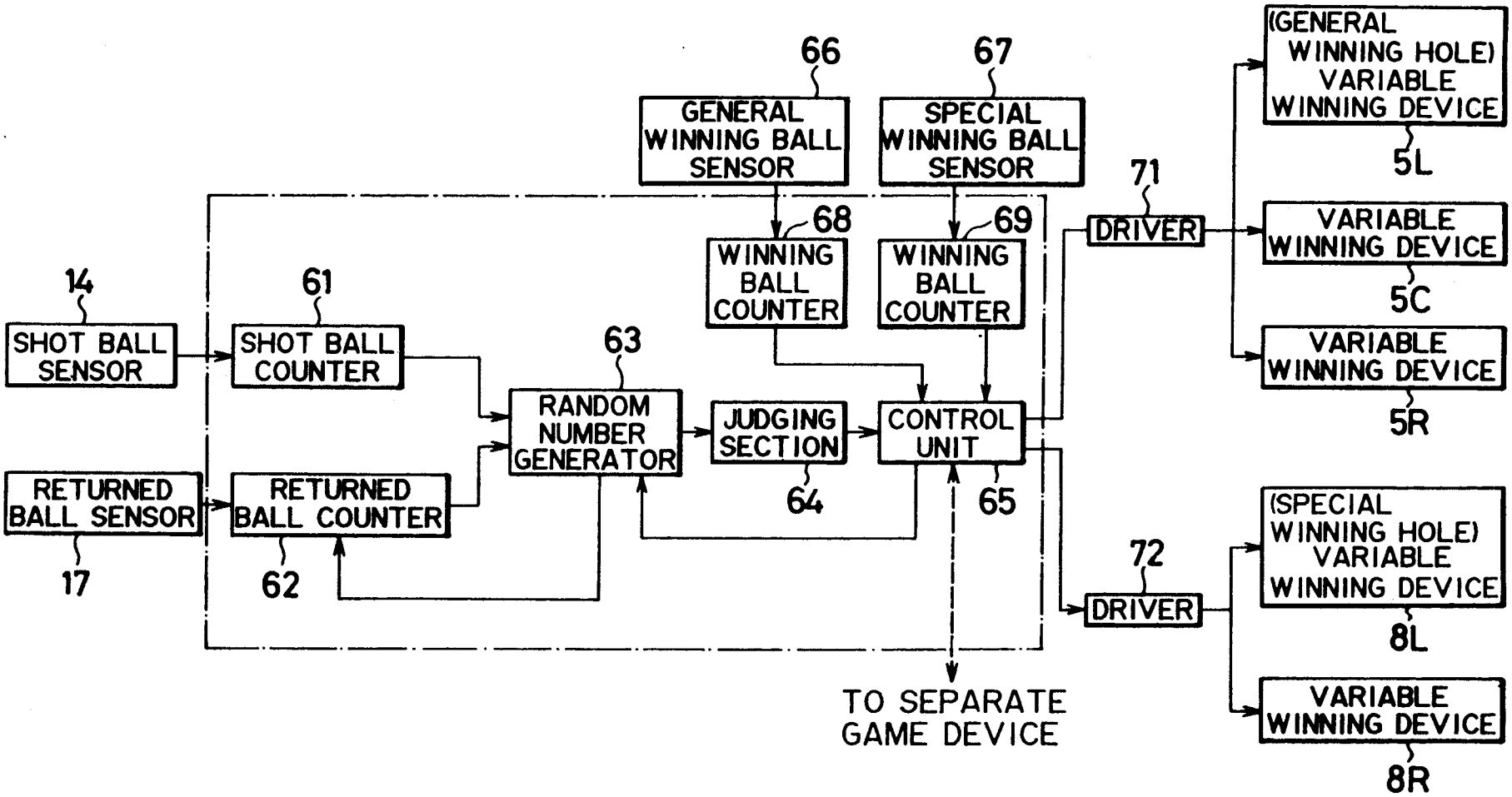
FIG. 8 is a block diagram showing an electric circuit section according to one embodiment of this invention.

As shown in FIG. 8, the section includes a shot ball counter 61 and a returned ball counter 62, which receive detection signals from the respective shot and returned ball sensors 14 and 17 respectively as previously noted, a random number generator 63 for generating random numbers according to the outputs of the counters 61 and 62, a judging section 64 for judging the value of generated random number, and a control unit or section 65 for causing driving control of the plurality of variable winning devices according to the result of the judgement by the judging section 64 until a winning ball is produced in one of the variable winning devices.

In addition, three general winning ball sensors 66 and two special winning ball sensors 67 are provided as winning ball detection means for detecting winning balls produced in the general variable winning devices 5L, 5R, and 5C and the special variable winning devices 8L and 8R, respectively. Each winning ball sensor consists of a magnetic sensor having a hole, through which a ball can pass, which detects a winning ball from a magnetic field change produced when a ball emerging from the variable winning device passes through the hole. It is of course possible to use sensors other than magnetic sensors as described, for example an optical sensor, a microswitch, or the like. Detection signals from the individual winning ball sensors are supplied to an associated winning ball counter 68 and 69 which counts winning balls.

In the circuit of FIG. 8, the count of the shot ball counter 61 is increased by one every time the shot ball sensor 14 detects a shot ball P. The count of the returned ball counter 62 is increased by one every time the returned ball sensor 17 detects a returned ball P.

The random number generator 63 performs a predetermined calculation to generate a random number every time the count of the shot ball counter 61 is increased by one. However, the random number generator 63 generates a random number as long as the count of the returned ball counter 62 is "0", and does not generate any random number if the count is "1" or more. For example, if the count of the returned ball counter 62 is "2", the count output of the shot ball counter 61 is passed (i.e., no random number is generated) twice from the time of appearance of the count "2", and the count of the returned ball counter 62 is decreased by that number of times to "0".

When the random number generated from the random number generator 63 is a predetermined number, the variable winning devices of kind corresponding to that number (either general or special winning hole) are driven and controlled such that they assume the second state advantageous to the player. The probability at this time is predetermined depending on the type of winning hole. For example, where the range of random numbers which may be generated is from 1 to 4,096, by setting the random number range for the general winning hole to be from 1 to 91, the probability of winning the general prize is about one forty-fifth, and by setting the random number range for the special winning hole to be from 1,001 to 1,273, the probability of winning the special prize is about one fifteenth.

The judging section 64 judges whether a random number generated by the random number generator 63 is in either of the predetermined ranges as noted above.

When a generated random number is found to be a predetermine defective number as a result of the judgment or check by the judging section 64, the control section 65 supplies a drive signal to a driver section 71 for driving the general variable winning devices 5L, 5R, and 5C or to a driver section 72 for driving the special variable winning devices 8L and 8R, so that the driver section 71 or 72 drives the associated variable winning devices to assume the second state continuously or intermittently. When a winning ball is produced in any variable winning device being driven so that the counter 68 or 69 produces an output signal, the driving of variable winning devices is reversed to return them to be the first state disadvantageous to the player.

In the case of a ball-shooting game machine with the variable display device 7 for a separate game and the changeable winning device 20 as shown in FIG. 1, when a predetermined count is reached in the special winning ball counter 69 with production of a special winning ball (or when one winning ball is produced if the count is "1"), the control unit 65 supplies a signal to a drive section of the separate game device 7 to start the separate game. At the same time, the random number generator 63 generates a random number, which is checked by the judging section 64. If it is found that a big prize state is produced as a result of the separate game (the probability of this case being determined as well as the case of the variable winning devices), the display of the separate game device 7 is stopped at "BIG PRIZE", while a signal is produced for opening the door of the changeable winning device 20 for a predetermined period of time (this state is advantageous to the player). In case of a prize state other than the big prize state or a no-prize state, the separate game device 7 is stopped at a corresponding display, and in the case of the prize state a predetermined number of prize balls are paid out. This is the same as the usual pachinko game machine.

The shot and returned ball counters 61 and 62, the random number generator 63, the judging section 64, the control section 65 and the winning ball counters 66 and 67 are implemented by well-known electronic circuits, making it possible to permit a microcomputer to execute the operation of these components.

In such an embodiment, the microcomputer generates a random number whenever a predetermined number of balls are shot, and it sets a flag of "1" when the generated random number is a predetermined effective number; i.e., in a range corresponding to the general or special winning hole. In this embodiment, the flag is a state indication signal representing the number of winning balls (number of occasions of winning prize) that will be accepted when the associated variable winning devices are set to the second state advantageous to the player.

The microcomputer is programmed to provide a signal for driving the general variable winning devices 5L, 5R, and 5C or the special variable winning devices 8L and 8R corresponding to a predetermined flag so as to set the associated variable winning devices in the second state advantageous to the player either continuously or intermittently, and to stop the driving control; i.e., reverse it, when a winning ball is produced in either one of the variable winning devices.

If no winning ball is produced in the presence of the flag "1", a flag "2" is set when the next random number generation results in a predetermined effective number, so that the associated variable winning devices are controlled to permit winning balls until two winning balls are produced. The content of flag is increased by one at any time the predetermined effective number is generated if no winning ball is produced during the preceding flag.

On the other hand, if n winning balls are produced in the presence of a flag "1", then where an equals two or more, then the value of flag is set to (1−n) to cancel a flag, "1" produced at the next time of predetermined effective number generation. For example, if n=3, the next flag is "−2", which is changed to "−1" and then to "0" with generation of subsequent successive flags.

According to the invention, the first state of the variable winning device is not limited to the state which does not permit production of any winning ball, but may be a state which permits production of winning ball only with difficulty. In the latter case, a winning ball may be produced in a variable winning device in the first state; i.e., in the absence of the flag "1". Since such a winning ball is detected by the winning ball sensor 66 or 67, the microcomputer decreases the prevailing content of the flag corresponding to the general or special winning devices by one every time such a winning ball is produced, so that a flag "1" set at the next time of predetermined effective number generation can be cancelled. By compensating for the flag which represents the number of times of switching of the variable winning devices to the second state, using a microcomputer and in accordance the actual winning status, the driving control of the variable winning devices can be executed with a predetermined probability.

The probability of winning ball production in the variable winning devices may be set as desired by suitably varying the probability of generation of a predetermined random number to switch the variable winning devices to the second state. The probability of production of a given result in the separate game may be similarly set.

While a preferred embodiment of the invention has been described in the foregoing, the present invention is applicable not only to a pachinko game machine but also other ball-shooting game machines such as a smart ball game machine and a mah-jong ball game machine. Further, it is possible to properly select the constructions of the shot ball detection means, control means and variable winning device, and also the modes of winning control.

As explained above, in a ball-shooting game machine according to the present invention, the winning control is effected in accordance with a predetermined probability whenever a predetermined number of game balls are shot. Therefore, it is possible to provide a constant probability of winning ball production, thus making the conventional subtle nail adjustment unnecessary. In addition, a player is given an impartial opportunity of winning a prize and can thus enjoy the ball-shooting game without need of any skill for the game.

I claim:

1. A ball-shooting game machine for playing a game by shooting balls from a ball shooter to a game zone over a game board, comprising a winning ball production control, a shot ball detection means for providing an output signal every time a predetermined number of balls is shot from said ball shooter, means for generating a random number in response to said output signal from said shot ball detection means and means for activating said winning ball production control to effect an advantageous state to a player depending upon the random number generated.

2. A ball-shooting game machine having a ball shooter for shooting game balls to a game zone over a game board, one or more variable winning devices capable of being driven to assume a first state disadvantageous to a player and a second state advantageous to a player regarding production of winning balls from said game balls shot from said ball shooter, and drive means for driving said variable winning device to assume said first and second states, said ball shooting game machine comprising:

shot ball detection means for detecting game balls shot from said ball shooter;

random number generation means for generating random numbers in response to an output signal from said shot ball detection means;

judging means for checking said random numbers generated from said random number generation means against preselected numbers; and control means responsive to said judging means for causing said drive means to drive said variable winning devices when a random number is generated corresponding to said preselected numbers and until a predetermined number of winning balls is produced in said variable winning devices.

3. The ball-shooting game machine according to claim 2, wherein said variable winning devices are classified into general winning devices and special winning devices, and further comprising a separate game device for playing a separate game when a winning ball is produced in said special winning device and a changeable winning device capable of assuming a state advantageous to a player according to a result of said separate game by said separate game device.

4. A ball-shooting game machine having one or more variable winning devices capable of being driven to assume a first state disadvantageous to a player and a second state advantageous to a player regarding production of winning balls from game balls shot from said ball shooter, said ball-shooting game machine comprising:

random number generation means for generating random numbers;

judging means for checking said random numbers generated from said random number generation means against preselected numbers; and control means responsive to said judging means for determining the state of said variable winning devices when a random number is generated corresponding to said preselected numbers, generating a state indication signal representing the determined state, and driving said variable winning devices according to a content of said state indication signal, said control means further compensating the content of said state indication signal in accordance with the status of said production of winning balls.

5. The ball shooting game machine according to claim 4, wherein said state indication signal represents a number of acceptable winning balls in said second state of said variable winning devices, said state indication signal being changed if said number of acceptable winning balls fails to be produced until a next state indication signal is generated, to a value equal to the number of the next indication signal plus a number equal to the number of said acceptable winning balls which failed to be produced.

6. The ball shooting game machine according to claim 5, wherein said state indication signal represents the number of acceptable winning balls in said second state of said variable winning devices, said state indication signal being changed, if winning balls are produced in excess of said number of acceptable winning balls until the next state indication signal is generated, to a value equal to the number of the next indication signal minus a number equal to the number of said excess winning balls.

7. The ball-shooting game machine according to claim 4, wherein said control means generates a state indication signal for cancelling subsequent driving to said second state of said variable winning devices every time a winning ball is produced in said variable winning devices in said first state.

8. A ball-shooting game machine for playing a game by shooting balls from a ball shooter to a game zone over a game board, comprising at least one winning device within said game zone, a winning ball production control associated with said winning device sufficient to effect a first state disadvantageous to the player and a second state advantageous to said player, a shot ball detection means for producing an output signal every time a predetermined number of balls is shot from said ball shooter, means for generating a random number in response to said output signal from said shot ball detection means and control means for driving said winning ball production control depending upon the random number generated, to effect said second state advantageous to said player.

9. The ball-shooting machine according to claim 8, which further comprises means for returning balls towards said ball shooter which do not reach said game zone after being shot from said ball shooter, a returned ball detection means for detecting said game balls returned toward said ball shooter, said control means refraining from random number generation a number of times corresponding to the number of detected returned balls.

* * * * *